US006601419B2

(12) United States Patent
Huang et al.

(10) Patent No.: US 6,601,419 B2
(45) Date of Patent: Aug. 5, 2003

(54) ANTI-THEFT TUMBLER PINS OF A LOCK CORE

(75) Inventors: Mao-Ming Huang, Kaohsiung (TW); Kai-An Wu, Pingtong (TW)

(73) Assignee: Kai-An Wu, Pingtong (TW)

( * ) Notice: Subject to any disclaimer, the term of this patent is extended or adjusted under 35 U.S.C. 154(b) by 117 days.

(21) Appl. No.: 09/814,850

(22) Filed: Mar. 23, 2001

(65) Prior Publication Data

US 2001/0029761 A1 Oct. 18, 2001

(30) Foreign Application Priority Data

Apr. 18, 2000 (TW) ..... 89107499 A

(51) Int. Cl.[7] ..... E05B 27/06; E05B 29/14; E05B 31/00

(52) U.S. Cl. ..... 70/358; 70/419; 70/356; 70/493

(58) Field of Search ..... 70/358, 351, 352, 70/356, 390, 416, 418–421, 347, 493, DIG. 23, DIG. 25, DIG. 22, 348, 359, 369, 378, 386

(56) References Cited

U.S. PATENT DOCUMENTS 1,707,922 A * 4/1929 Pepper ..... 70/421
1,979,938 A * 11/1934 Jacobi ..... 70/46
2,863,973 A * 12/1958 Schillizzi ..... 70/421
3,009,349 A * 11/1961 Check ..... 70/369
3,541,822 A * 11/1970 Murphy ..... 70/421
3,605,463 A * 9/1971 Epstein ..... 70/378
3,670,540 A * 6/1972 Fernandez ..... 70/379 R
3,774,423 A * 11/1973 Orr ..... 70/367
3,968,668 A * 7/1976 Epstein ..... 70/379 R
4,434,636 A * 3/1984 Prunbauer ..... 70/358
4,580,425 A * 4/1986 Smith ..... 70/421
4,961,328 A * 10/1990 Mundhenke ..... 70/1.5

* cited by examiner

*Primary Examiner*—Anthony Knight
*Assistant Examiner*—John B. Walsh
(74) *Attorney, Agent, or Firm*—Troxell Law Office PLLC

(57) ABSTRACT

A lock core device of an anti-theft tumbler pin type includes a housing defining a lock core hole, a plurality of first tumbler pin holes, at least one side tumbler pin hole, and a transverse hole, a lock core rotatably mounted in the housing and defining a plurality of second tumbler pin holes which are moved by the lock core to align with the first tumbler pin holes and to align with the side tumbler pin hole, a plurality of tumbler pin sets each slidably mounted in the first tumbler pin hole and each including a top tumbler pin and a bottom tumbler pin movable in the second tumbler pin hole, at least one block pin slidably mounted in the side tumbler pin hole and rested on a peripheral wall of the lock core or inserted into the second tumbler pin hole, and a control tumbler pin set slidably mounted in the transverse hole and including a transverse tumbler pin rested on the block pin. When the block pin is inserted into the second tumbler pin hole, the transverse tumbler pin is rested on a top end of the block pin.

7 Claims, 6 Drawing Sheets

ANTI-THEFT TUMBLER PINS OF A LOCK CORE

BACKGROUND OF THE INVENTION

1. Field of the Invention

The present invention relates to anti-theft tumbler pins of a lock core, and more particularly to a lock core device of an anti-theft tumbler pin type.

2. Description of the Related Art

A conventional lock core device of a tumbler pin type in accordance with the prior art shown in FIGS. 1–3 comprises a housing 1, a lock core 2, and a plurality of tumbler pin sets 3.

The housing 1 defines a lock core hole 11 and a plurality of tumbler pin holes 12 each communicating with the lock core hole 11. The lock core 2 is rotatably mounted in the lock core hole 11 of the housing 1 and defines a key slot 22 which allows insertion of a key 4 for rotating the lock core 2.

The lock core 2 has a distal end provided with a drive member 23 for controlling opening/closing action of the lock. The lock core 2 defines a plurality of tumbler pin holes 21 each communicating with the key slot 22. The tumbler pin holes 21 of the lock core 2 are moved to align with the tumbler pin holes 12 of the housing 1 when the lock core 2 is rotated.

Each of the tumbler pin sets 3 is mounted in the tumbler pin hole 12 of the housing 1 and the tumbler pin hole 21 of the lock core 2, and includes a top tumbler pin 32, a bottom tumbler pin 31, an elastic member 33, and a seal 34. The top tumbler pin 32 and the bottom tumbler pin 31 are movable in the tumbler pin hole 21 of the lock core 2. The top tumbler pin 32 of each of the tumbler pin sets 3 is urged by the elastic member 33 to enter the tumbler pin hole 21 of the lock core 2 as shown in FIG. 2, thereby preventing the lock core 2 from being rotated relative to the housing 1.

In operation, the top tumbler pin 32 of each of the tumbler pin sets 3 is located between the tumbler pin hole 12 of the housing 1 and the tumbler pin hole 21 of the lock core 2 as shown in FIG. 2 so that the lock core 2 cannot be rotated. When the key 4 is inserted into the key slot 22 of the lock core 2, the bottom tumbler pin 31 of each of the tumbler pin sets 3 is pressed upward by the key 4 to push the top tumbler pin 32 upward, thereby detaching the top tumbler pin 32 from the tumbler pin hole 21 of the lock core 2 as shown in FIG. 3 so that the lock core 2 can be rotated freely.

However, a person can use a wire or other drive tool to in turn press the bottom tumbler pin 31 of each of the tumbler pin sets 3 upward so as to push the top tumbler pin 32 upward, thereby detaching the top tumbler pin 32 from the tumbler pin hole 21 of the lock core 2 so that the lock core 2 can be rotated freely.

SUMMARY OF THE INVENTION

The primary objective of the present invention is to provide a lock core device of an anti-theft tumbler pin type comprising:

a tubular housing defining a lock core hole and a plurality of first tumbler pin holes each communicating with the lock core hole, at least one side tumbler pin hole defined in the housing and communicating with the lock core hole, the first tumbler pin holes and the at least one side tumbler pin hole being spaced from each other in a radiating manner about the lock core hole, a transverse hole defined in the housing and communicating with the at least one side tumbler pin hole;

a lock core rotatably mounted in the housing and defining a key slot and a plurality of second tumbler pin holes each communicating with the key slot, the lock core including a drive member and being restricted by a positioning member to rotate relative to the housing through a pre-determined angle, and the second tumbler pin holes of the lock core being moved to align with the first tumbler pin holes of the housing and being moved to align with the at least one side tumbler pin hole of the housing when the lock core is rotated;

a plurality of tumbler pin sets each mounted in the first tumbler pin hole of the housing and the second tumbler pin hole of the lock core, each of the tumbler pin sets including a top tumbler pin, a bottom tumbler pin, and a first elastic member, wherein the top tumbler pin and the bottom tumbler pin are movable in the second tumbler pin hole of the lock core;

at least one block pin slidably mounted in the at least one side tumbler pin hole of the housing, wherein the at least one block pin is rested on a peripheral wall of the lock core or is inserted into the second tumbler pin hole of the lock core; and a control tumbler pin set mounted in the transverse hole of the housing and including a transverse tumbler pin and a second elastic member, the transverse tumbler pin of the control tumbler pin set having a front end rested on the at least one block pin, wherein when the at least one block pin is inserted into the second tumbler pin-hole of the lock core, the transverse tumbler pin of the control tumbler pin set is rested on a top end of the at least one block pin.

By such an arrangement, if a person does not use a correct key to be inserted into the key slot of the lock core, the lock core can only be rotated through a small angle and will be jammed by the block pin in conjunction with the transverse tumbler pin so that the lock core cannot be further rotated, thereby achieving an anti-theft function.

In addition, the manufacturer may register marks and numbers of the keys so that the flow direction of the lock core device of an anti-theft tumbler pin type of the present invention can be efficiently managed and controlled. In such a manner, when the user's key is lost, an ordinary locksmith cannot directly open the lock core device, and it is necessary to re-manufacture a correct key according to the marks or numbers registered by the manufacturer.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
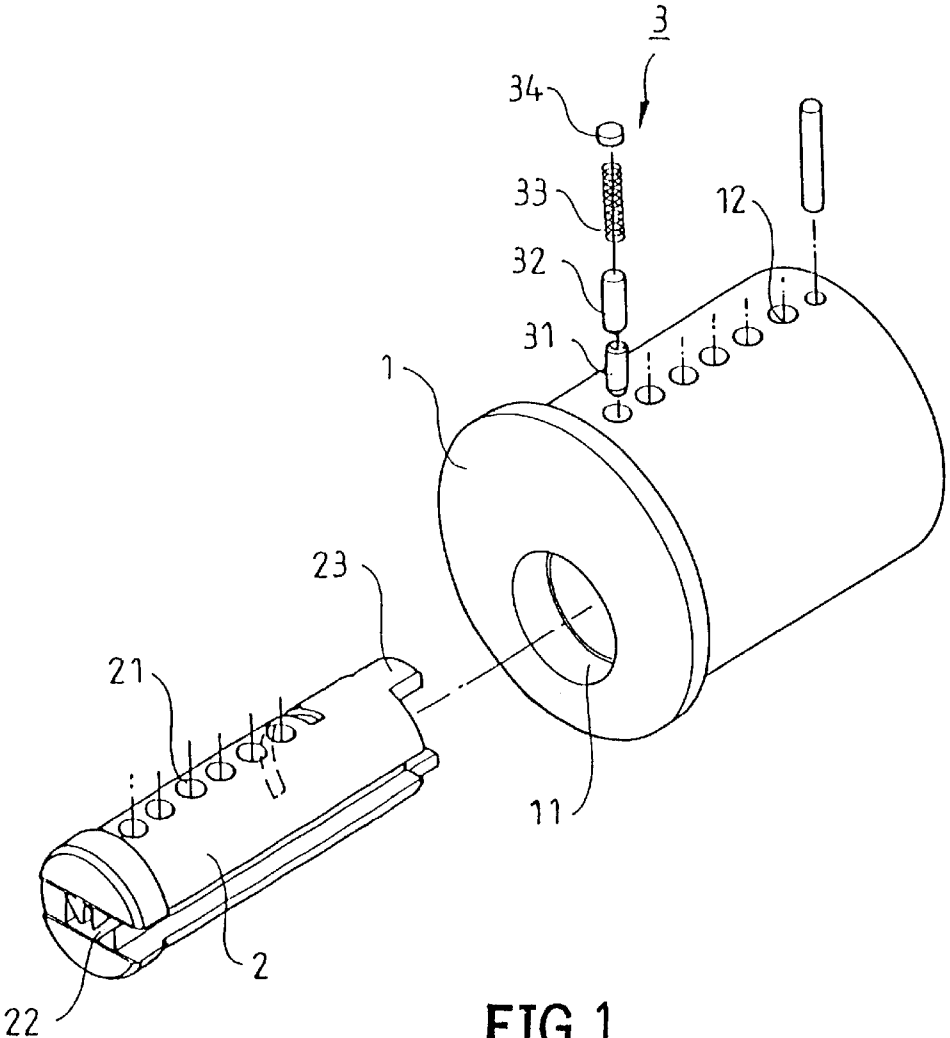
FIG. 1 PRIOR ART
FIG. 1 is an exploded perspective view of a conventional lock core device of a tumbler pin type in accordance with the prior art.
Figure 3:
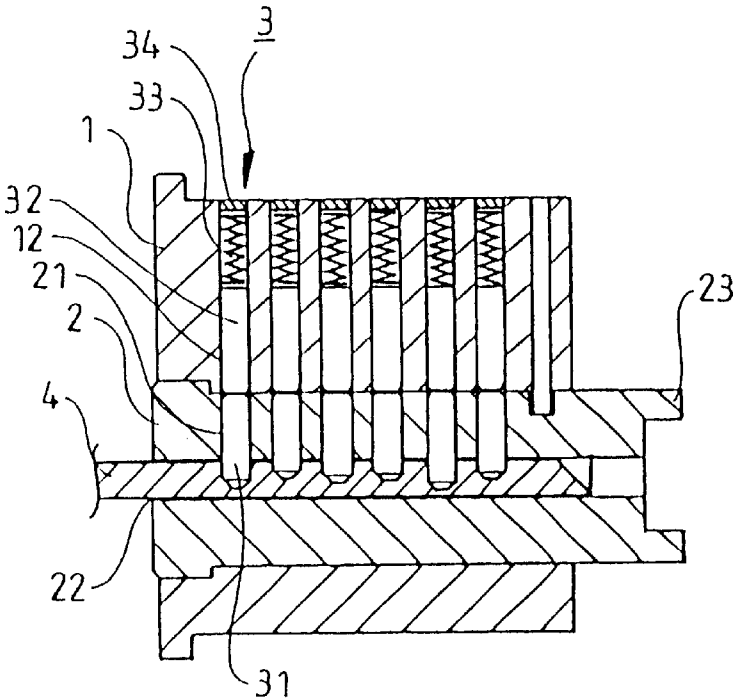
FIG.3 PRIOR ART
FIG. 3 is an operational view of the conventional lock core device of a tumbler pin type as shown in FIG. 2.
Figure 2:
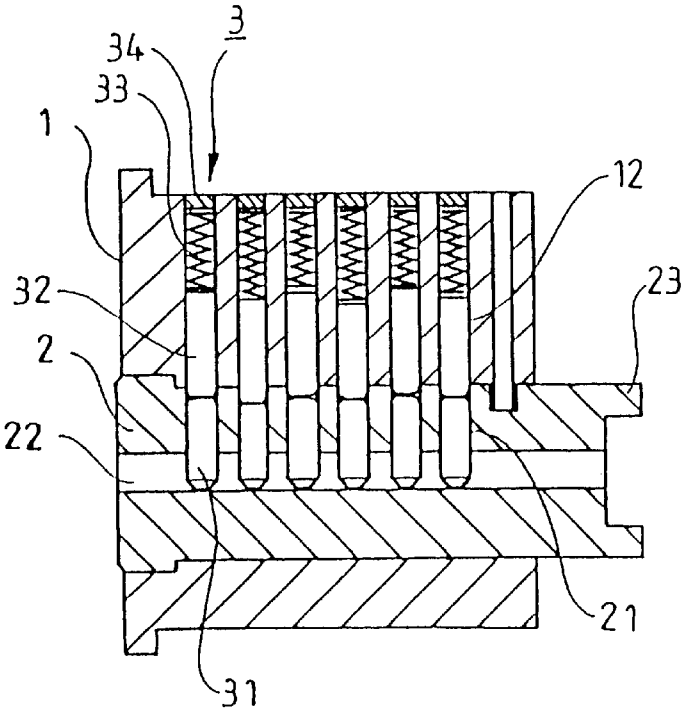
FIG.2 PRIOR ART
FIG. 2 is a side plan cross-sectional assembly view of the conventional lock core device of a tumbler pin type as shown in FIG. 1.
Figure 4:
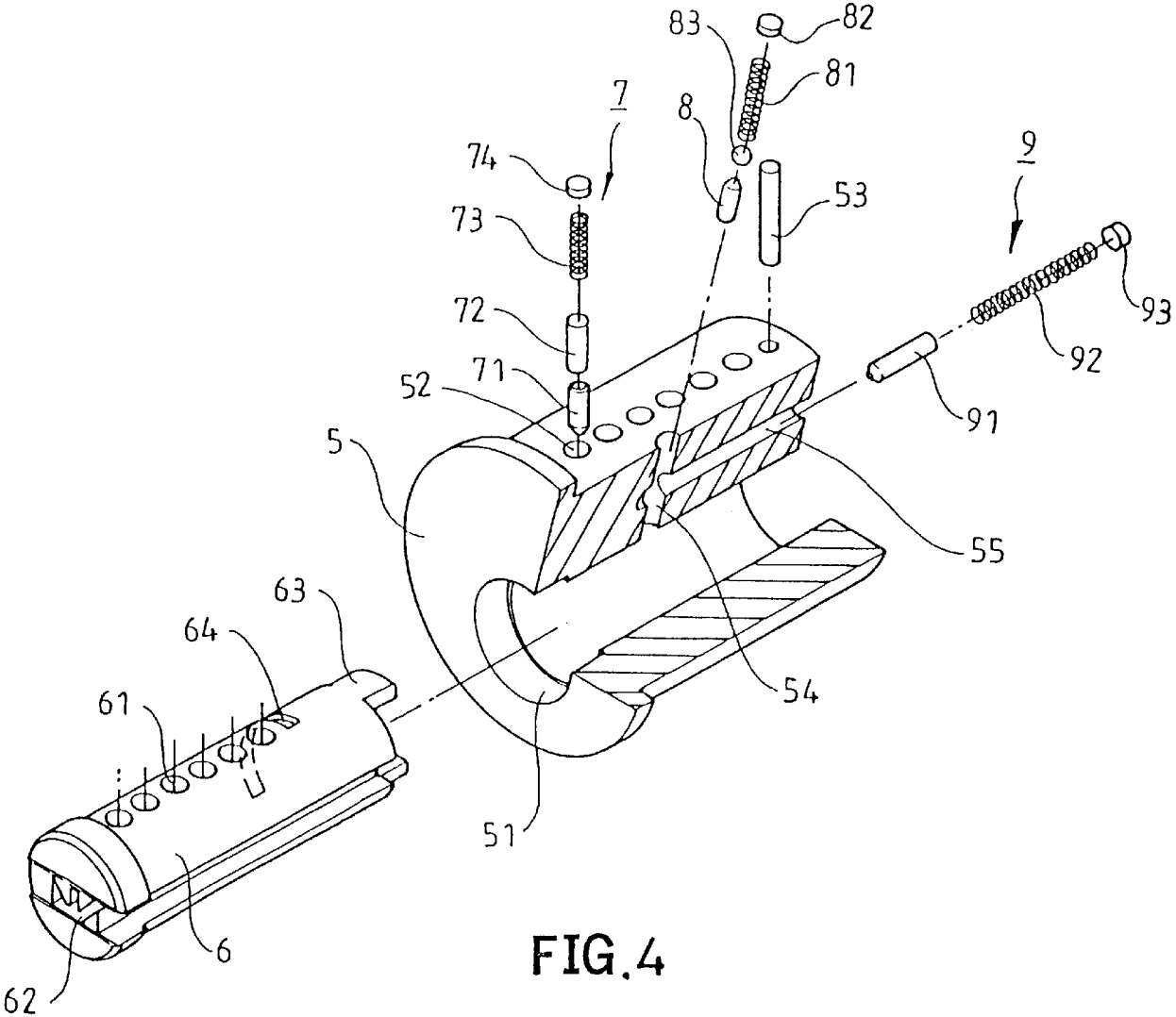
FIG. 4 is an exploded perspective view of a lock core device of an anti-theft tumbler pin type in accordance with the present invention.
Figure 6:
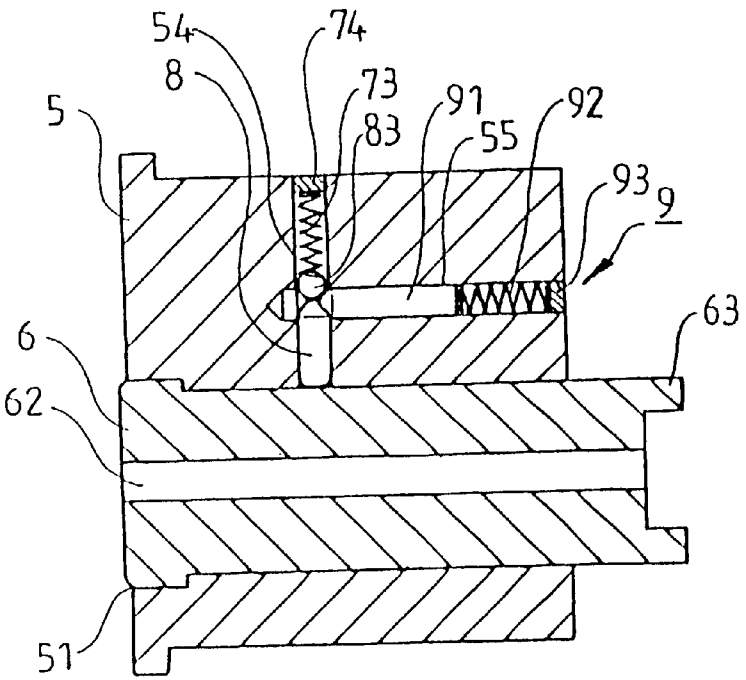
FIG. 6 is a side plan cross-sectional view of the lock core device of an anti-theft tumbler pin type along the line 6—6 as shown in FIG. 5.
Figure 5:
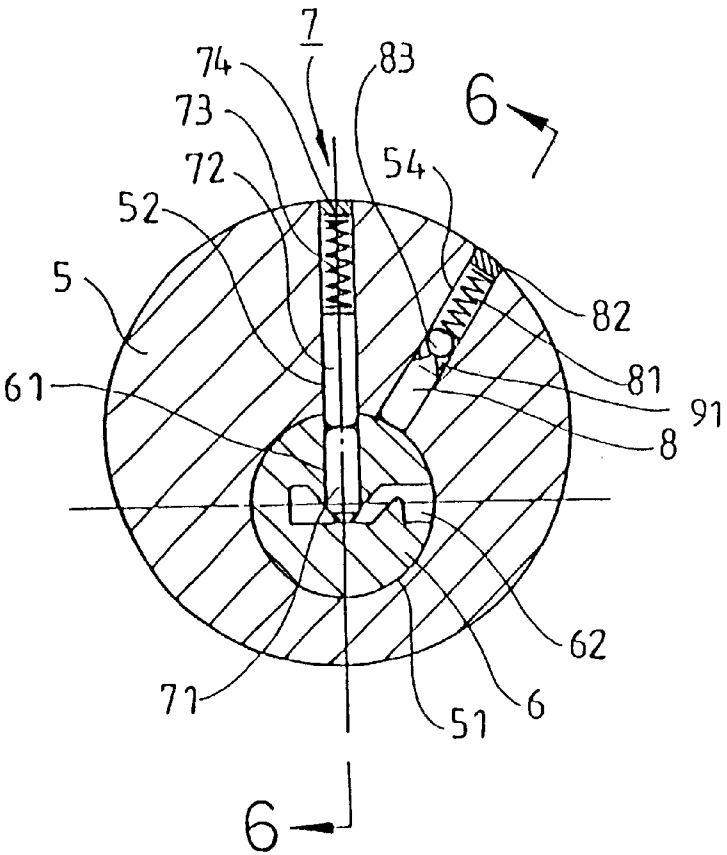
FIG. 5 is a front plan cross-sectional assembly view of the lock core device of an anti-theft tumbler pin type as shown in FIG. 4.

Referring to FIGS. 4–6, a lock core device of an anti-theft tumbler pin type in accordance with the present invention generally includes a tubular housing 5, a lock core 6, a plurality of tumbler pin sets 7, at least one block pin 8, and a control tumbler pin set 9.

The tubular housing 5 defines an axial lock core hole 51 and a plurality of first tumbler pin holes 52 each communicating with the lock core hole 51. At least one side tumbler pin hole 54 is defined in the housing 5 and communicating with the lock core hole 51. The first tumbler pin holes 52 and the side tumbler pin hole 54 are spaced from each other in a radiating manner about the lock core hole 51. A transverse hole 55 is defined in the housing 5 and communicating with the side tumbler pin hole 54. Preferably, the transverse hole 55 of the housing 5 communicates with the side tumbler pin hole 54 and intersects the side tumbler pin hole 54.

The lock core 6 is rotatably mounted in the lock core hole 51 of the housing 5 and defines an axial key slot 62 which allows insertion of a key 4 (see FIG. 7) for rotating the lock core 6. The lock core 6 has a distal end provided with a drive member 63 for controlling opening/closing action of the lock. The drive member 63 of the lock core 6 is adapted to be an integral drive block or an additionally combined drive bar.

The rotation of the lock core 6 is restricted by a positioning member 53 so that the lock core 6 can be rotated relative to the housing 5 through a predetermined angle. The lock core 6 preferably defines an annular groove 64 for receiving the positioning member 53 so that the lock core 6 is limited to rotate relative to the housing 5 through a predetermined angular interval.

The lock core 6 also defines a plurality of second tumbler pin holes 61 each communicating with the key slot 62. The second tumbler pin holes 61 of the lock core 6 are moved to align with the first tumbler pin holes 52 of the housing 5 and are moved to align with the side tumbler pin hole 54 of the housing 5 when the lock core 6 is rotated.

Each of the plurality of tumbler pin sets 7 is mounted in the first tumbler pin hole 52 of the housing 5 and the second tumbler pin hole 61 of the lock core 6, and includes a top tumbler pin 72, a bottom tumbler pin 71, a first elastic member 73, and a first seal 74. The top tumbler pin 72 and the bottom tumbler pin 71 are movable in the second tumbler pin hole 61 of the lock core 6.

The top tumbler pin 72 of each of the tumbler pin sets 7 is urged by the first elastic member 73 to enter the second tumbler pin hole 61 of the lock core 6 as shown in FIG. 5, thereby preventing the lock core 6 from being rotated relative to the housing 5.

Figure 10:
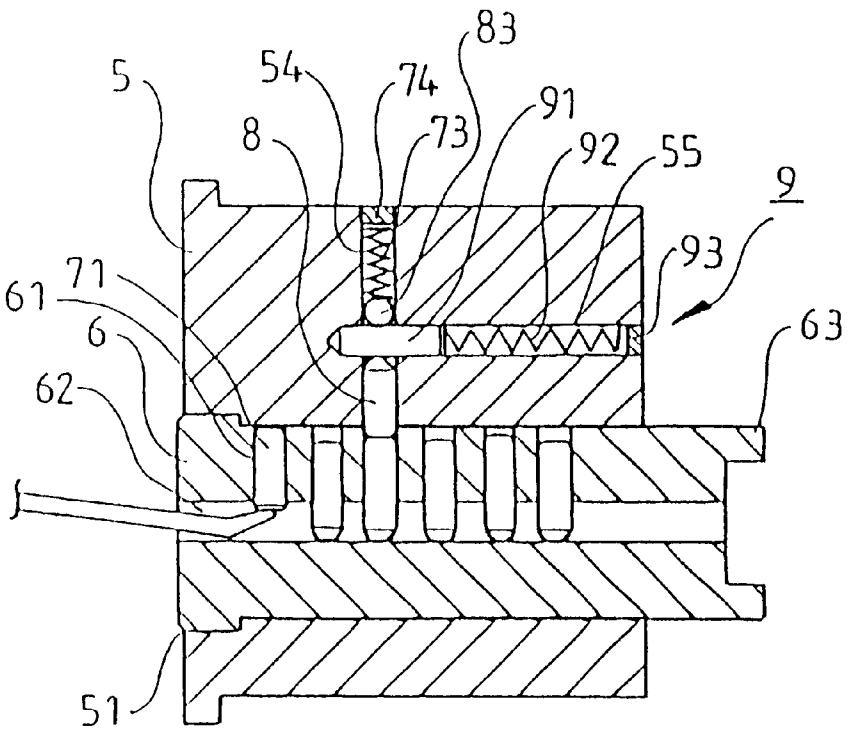
FIG. 10 is a side plan cross-sectional view of the lock core device of an anti-theft tumbler pin type as shown in FIG. 9.
Figure 9:
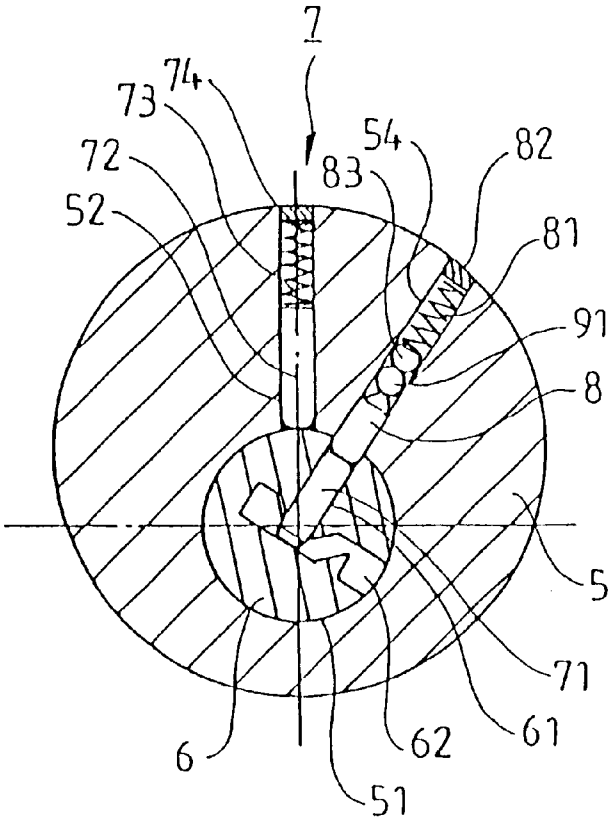
FIG. 9 is an operational view of the lock core device of an anti-theft tumbler pin type as shown in FIG. 8.

The block pin 8 is slidably mounted in the side tumbler pin hole 54 of the housing 5. The block pin 8 can be rested on a peripheral wall of the lock core 6 as shown in FIGS. 5 and 6 or can be inserted into the second tumbler pin hole 61 of the lock core 6 as shown in FIGS. 9 and 10. An elastic member 81 is mounted in the side tumbler pin hole 54 of the housing 5 for pressing the block pin 8. A ball 83 is to mounted in the side tumbler pin hole 54 of the housing 5 and is located between the elastic member 81 and the block pin 8. A seal 82 is secured in the side tumbler pin hole 54 of the housing 5 and is urged on the elastic member 81.

The control tumbler pin set 9 is mounted in the transverse hole 55 of the housing 5 and includes a transverse tumbler pin 91, a second elastic member 92, ad a second seal 93. The transverse tumbler pin 91 of the control tumbler pin set 9 has a front end rested on the block pin 8 as shown in FIG. 6. When the block pin 8 is inserted into the second tumbler pin hole 61 of the lock core 6, the transverse tumbler pin 91 of the control tumbler pin set 9 is rested on a top end of the at least one block pin 8 as shown in FIG. 10. Preferably, the second elastic member 92 of the control tumbler pin set 9 has an elastic force greater than that of the third elastic member 81 of the at least one block pin 8. Preferably, each of the transverse tumbler pin 91 and the block pin 8 has a cone-shaped abutting end abutting each other.

In operation, referring to 5–10 with reference to FIG. 4, the top tumbler pin 72 of each of the tumbler pin sets 7 is located between the first tumbler pin hole 52 of the housing 5 and the second tumbler pin hole 61 of the lock core 6 as shown in FIG. 5 so that the lock core 6 cannot be rotated. At the same time, the block pin 8 is rested on the peripheral wall of the lock core 6 while the movement of the transverse tumbler pin 91 is stopped by the block pin 8 as shown in FIG. 6.

Figure 7:
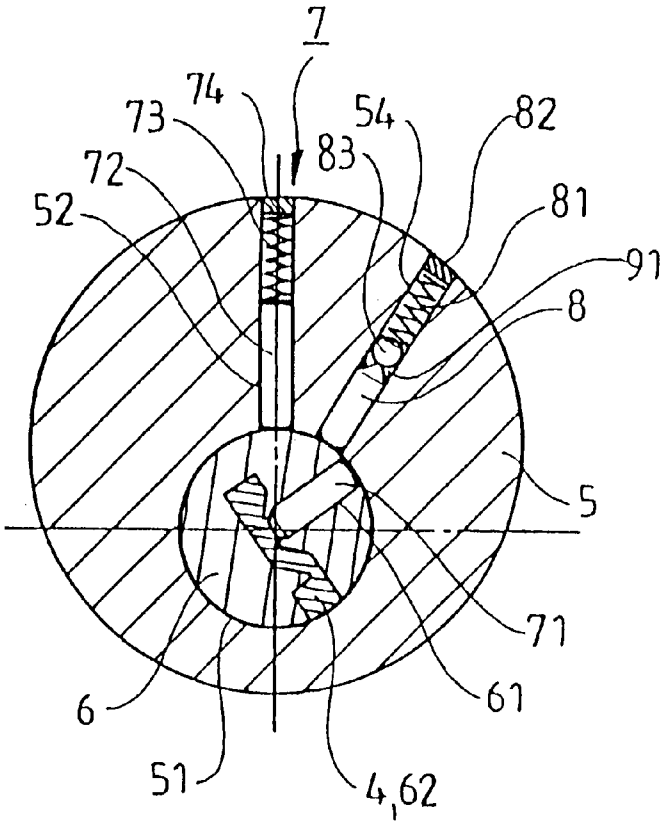
FIG. 7 is an operational view of the lock core device of an anti-theft tumbler pin type as shown in FIG. 5.

As shown in FIG. 7, when the key 4 is inserted into the key slot 62 of the lock core 6, the bottom tumbler pin 71 of each of the tumbler pin sets 7 is pressed upward by the key 4 to push the top tumbler pin 72 upward, thereby detaching the top tumbler pin 72 from the tumbler pin hole 61 of the lock core 6 so that the lock core 6 can be rotated freely. At the same time, the block pin 8 is rested on the peripheral wall of the lock core 6 when the lock core 6 is rotated.

Figure 8:
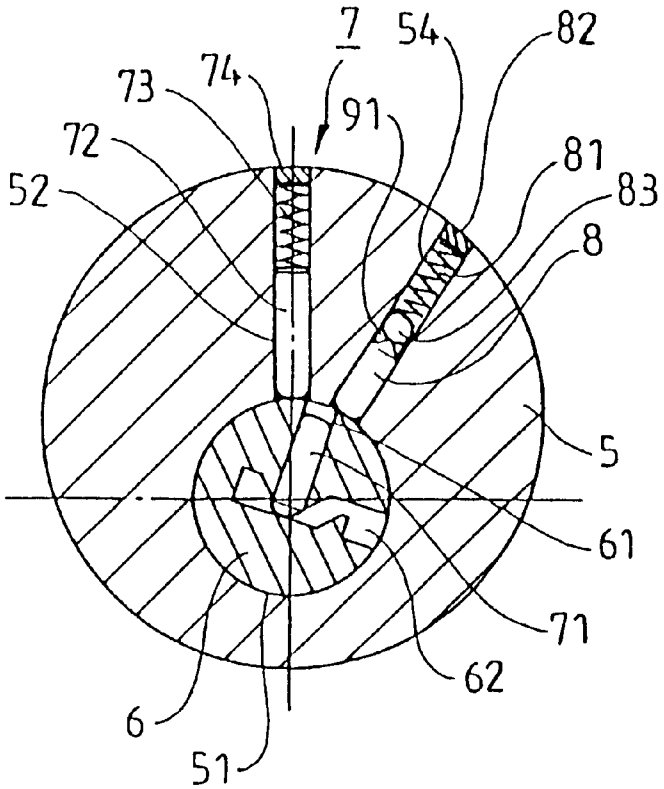
FIG. 8 is an operational view of the lock core device of an anti-theft tumbler pin type as shown in FIG. 5.

As shown in FIG. 8, a person may use a wire or other drive tool to push the top tumbler pin 72 upward to detach the top tumbler pin 72 from the tumbler pin hole 61 of the lock core 6 so that the lock core 6 can be rotated. However, the bottom tumbler pin 71 is not supported by the key 4 so that the bottom of the bottom tumbler pin 71 is lowered to the lowermost position of the tumbler pin hole 61 of the lock core 6 to form a clearance between the top of the bottom tumbler pin 71 and the peripheral surface of the lock core 6.

As shown in FIGS. 9 and 10, when the lock core 6 is moved from the position as shown in FIG. 8 to the position as shown in FIG. 9, the second tumbler pin hole 61 of the lock core 6 aligns with the side tumbler pin hole 54 of the housing 5 so that the block pin 8 is pressed to be inserted into the second tumbler pin hole 61 of the lock core 6 while the transverse tumbler pin 91 is pressed by the elastic member 92 to block the block pin 8 as shown in FIG. 10, thereby preventing the block pin 8 from return to its original position so that the lock core 6 cannot be further rotated due to the block pin 8.

Accordingly, if a person does not use a correct key 4 to be inserted into the key slot 62 of the lock core 6, the lock core 6 can only be rotated through a small angle and will be jammed by the block pin 8 in conjunction with the transverse tumbler pin 9 so that the lock core 6 cannot be further rotated without using the correct key 4. In such a manner, the block pin 8 in conjunction with the transverse tumbler pin 91 can be used to stop further rotation of the lock core 6 so that it is necessary to use the correct key 4 for rotating the lock core 6 arbitrarily, thereby achieving an anti-theft function.

In addition, the manufacturer may register marks and numbers of the keys so that the flow direction of the lock core device of an anti-theft tumbler pin type of the present invention can be efficiently managed and controlled. In such a manner, when the user's key is lost, an ordinary locksmith cannot directly open the lock core device, and it is necessary to re-manufacture a correct key according to the marks or numbers registered by the manufacturer, thereby protecting the user's safety, and thereby protecting the service of the salesman after sale.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A lock core device of an anti-theft tumbler pin type comprising: a tubular housing (5) defining a lock core hole (51) and a plurality of first tumbler pin holes (52) each communicating with the lock core hole (51), at least one side tumbler pin hole (54) defined in the housing (5) and communicating with the lock core hole (51), the first tumbler pin holes (52) and the at least one side tumbler pin hole (54) being spaced from each other in a radiating manner about the lock core hole (51), a transverse hole (55) defined in the housing (5) and communicating with the at least one side tumbler pin hole (54);

a lock core (6) rotatably mounted in the housing (5) and defining a key slot (62) and a plurality of second tumbler pin holes (61) each communicating with the key slot (62), the lock core (6) including a drive member (63) and being restricted by a positioning member (53) to rotate relative to the housing (5) through a pre-determined angle, and the second tumbler pin holes (61) of the lock core (6) being moved to align with the first tumbler pin holes (52) of the housing (5) and being moved to align with the at least one side tumbler pin hole (54) of the housing (5) when the lock core (6) is rotated;

a plurality of tumbler pin sets (7) each mounted in the first tumbler pin holes (52) of the housing (5) and the second tumbler pin holes (61) of the lock core (6), each of the tumbler pin sets (7) including a top tumbler pin (72), a bottom tumbler pin (71), and a first elastic member (73), wherein the top tumbler pin (72) and the bottom tumbler pin (71) are movable in the second tumbler pin holes (61) of the lock core (6);

at least one block pin (8) slidably mounted in the at least one side tumbler pin hole (54) of the housing (5), wherein the at least one block pin (8) is rested on a peripheral wall of the lock core (6) or is inserted into the second tumbler pin hole (61) of the lock core (6);

and a control tumbler pin set (9) mounted in the transverse hole (55) of the housing (5) and including a transverse tumbler pin (91) and a second elastic member (92), the transverse tumbler pin (91) of the control tumbler pin set (9) having a front end rested on the at least one block pin (8), wherein when the at least one block pin (8) is inserted into the second tumbler pin hole (61) of the lock core (6), the transverse tumbler pin (91) of the control tumbler pin set (9) is rested on a top end of the at least one block pin (8); wherein each of the transverse tumbler pin (91) and the at least one block pin (8) has a cone-shaped abutting end abutting each other.

2. The lock core device of an anti-theft tumbler pin type as claimed in claim 1, wherein the transverse hole (55) of the housing (5) is communicating with the at least one side tumbler pin hole (54) and intersects the at least one side tumbler pin hole (54).

3. The lock core device of an anti-theft tumbler pin type as claimed in claim 1, further comprising a third elastic member (81) mounted in the at least one side tumbler pin hole (54) of the housing (5) for pressing the at least one block pin (8).

4. The lock core device of an anti-theft tumbler pin type as claimed in claim 3, further comprising a ball (83) mounted in the at least one side tumbler pin hole (54) of the housing (5) and located between the third elastic member (81) and the at least one block pin (8).

5. The lock core device of an anti-theft tumbler pin type as claimed in claim 1, wherein the lock core (6) defines an annular groove (64) for receiving the positioning member (53) so that the lock core (6) is limited to rotate relative to the housing (5) through a pre-determined angular interval.

6. The lock core device of an anti-theft tumbler pin type as claimed in claim 1, wherein the drive member (63) of the lock core (6) is adapted to be an integral drive block or an additionally combined drive bar.

7. The lock core device of an anti-theft tumbler pin type as claimed in claim 3, wherein the second elastic member (92) of the control tumbler pin set (9) has an elastic force greater than that of the third elastic member (81) of the at least one block pin (8).

* * * * *